United States Patent [19]

de Vulpillieres

[11] 4,274,380

[45] Jun. 23, 1981

[54] CHECK VALVE CENTRAL METERING INJECTION SYSTEM

[75] Inventor: Didier J. de Vulpillieres, Southfield, Mich.

[73] Assignee: The Bendix Corporation, Southfield, Mich.

[21] Appl. No.: 8,463

[22] Filed: Feb. 1, 1979

[51] Int. Cl.[3] ..... B05B 9/06

[52] U.S. Cl. ..... 123/456; 123/457; 123/514; 137/563; 239/127

[58] Field of Search ..... 123/136, 139 AW, 456, 123/457, 459, 514; 239/124, 126, 127; 137/563

[56] References Cited

U.S. PATENT DOCUMENTS

| | | | |
|---|---|---|---|
| 2,747,555 | 5/1956 | Brunner | 239/127 |
| 3,025,001 | 3/1962 | Robson | 239/124 |
| 3,279,522 | 10/1966 | Norris | 137/563 |
| 3,327,760 | 6/1967 | Crawford | 137/563 |
| 3,431,900 | 3/1969 | Jackson | 123/139 AW |
| 3,489,128 | 1/1970 | Dinger | 123/136 |
| 3,628,727 | 12/1971 | Gjerde | 239/124 |
| 3,844,263 | 10/1974 | Endo | 123/139 AW |
| 4,007,755 | 2/1977 | Lerner | 137/563 |

FOREIGN PATENT DOCUMENTS

| | | | |
|---|---|---|---|
| 568456 | 1/1959 | Canada | 239/126 |
| 493553 | 10/1938 | United Kingdom | 137/563 |
| 856091 | 12/1960 | United Kingdom | 239/127 |

*Primary Examiner*—Charles J. Myhre
*Assistant Examiner*—Carl Stuart Miller
*Attorney, Agent, or Firm*—Markell Seitzman; Russel C. Wells

[57] ABSTRACT

A check valve central metering system for delivering determinable quantities of fuel to at least one fuel injection valve or injector of a fuel injected engine. The check valve central metering system containing a bi-level pressure regulating means, a 3-way valve, a check-valve, return lines and orifice interconnecting a fuel pump to a fuel rail adapted to receive at least one injector and connected in a fuel circulating mode during times not involving fuel injection and a dead-ended configuration during times involving fuel injection.

16 Claims, 5 Drawing Figures

FIG. 1
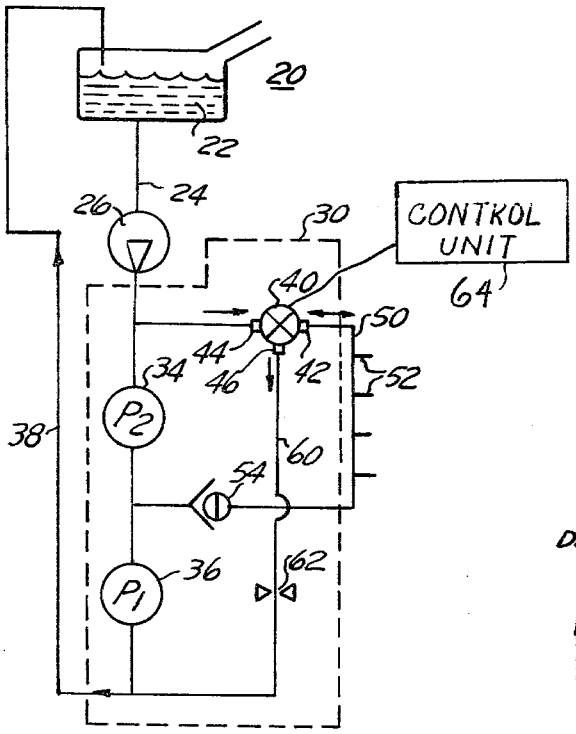
FIG. 3
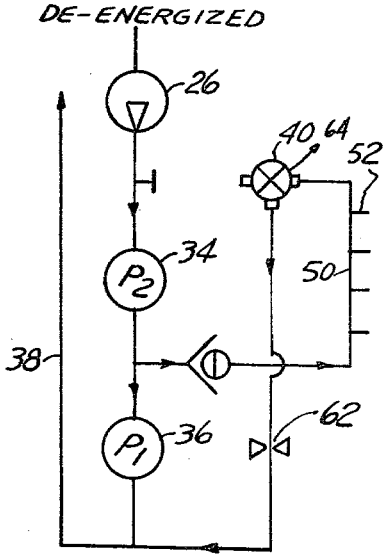
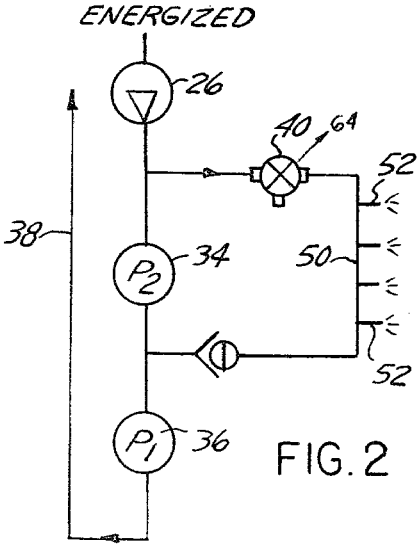
FIG. 2

CHECK VALVE CENTRAL METERING INJECTION SYSTEM

BACKGROUND AND SUMMARY OF THE INVENTION

The present invention relates to a fuel injection apparatus for internal combustion engines of the type having fuel injection valves or injectors. Fuel injection systems typically comprise a plurality of injectors connected to a fuel carrying conduit from a fuel reservoir by means of a pump. The injectors may be connected to the fuel carrying conduit directly or they may be connected by separate fuel lines. The injectors may be of the commonly known type of electromagnetic injector wherein each injector functions as a metering valve permitting a determinable amount of fuel to enter into the engine. Alternatively, the injectors may be of the type which open automatically when the pressure immediate the injector achieves a prescribed threshold. This latter type of valve performs no metering function. Metering is obtained by a mechanical or electrical centering valve. These pressure responsive injector valves are typically found in compression ignition diesel engines operating between pressures of 4500 psi and 10,000 psi or as may be found in a low pressure spark ignition engine wherein the valve may automatically open when the pressure approximate the valve reaches a pressure between 60 and 80 psi. The use of a single central metering valve in a multipoint fuel injection system has been disclosed by Monpetit et al. in U.S. Pat. No. 3,728,984 which issued on Apr. 24, 1973.

One of the problems identified with previously disclosed fuel distribution systems of this type is the fact that a non-negligible amount of fuel is trapped in the fuel lines connecting the injectors to the central metering valve. A consequence of this entrapped fuel can be seen from the following. During sustained engine operation the engine will invariably attain a relatively high operating temperature. When the engine is shut off the entrapped fuel will have a tendency to vaporize. This vaporization deteriorates the engine's performance during subsequent starts. The present invention obviates these problems.

According to the specific embodiment of the invention illustrated in the drawings of this application and discussed in detail below, the present invention supplies a determinable quantity of fuel to at least one of a plurality of fuel injection valves or injectors. The invention comprises a check valve metering system interconnecting a constant flow pump and fuel rail having at least one injector. The check valve metering system further comprising a bi-level pressure means including a series combination of two pressure regulators having an input end, a common node and output end. The input end is maintained in fluid communication with a fuel supply while the output end is in fluid communication with a return conduit to bring excess fluid back to the fuel supply. The input end and common node are in fluid communication with a series combination of two ports of a 3-way valve, fuel rail and check valve. A third port of the 3-way valve is selectively maintained in fluid communication with a second return conduit having a restriction such as an orifice. The second return conduit is connected in common to the return conduit and to the output of the bi-level pressure means. In accordance with teachings of the present invention the direction of flow through the fuel rail is determined by selectively porting the 3-way valve to the fuel rail or to the second return conduit in response to control signals input thereto. According to one aspect of the invention the fuel system can be operated in a fuel recirculating mode during periods of non-injection and in a reverse flow dead ended mode during periods involving fuel injection.

An advantage of the present invention is that rapid response is achieved by virtue of the independently selectable levels of regulated pressure. A further advantage of the present invention is that accurate fuel metering is achieved by virtue of the systems rapid response characteristics, the dead-ended configuration during injection, and the independently electrically actuated 3-way valve.

An object of the present invention is to meter fuel accurately. Another object of the present invention is to design a central metering injection system having a circulating fuel flow to the injectors which will retain the advantages of the central metering approach.

A further object of the present invention is to minimize performance variations resulting from fuel vaporization and air bubbles carried by the fuel.

Many other objects and purposes of the invention will be clear from the following description of the drawings.

BRIEF DESCRIPTION OF THE DRAWINGS

In the drawings:

FIG. 1 illustrates one embodiment of the invention.

FIG. 2 illustrates the fuel recirculating or non-injecting mode of the present invention.

FIG. 3 illustrates the dead-ended or injecting mode of the present invention.

DETAILED DESCRIPTION OF THE DRAWINGS

Figure 4:
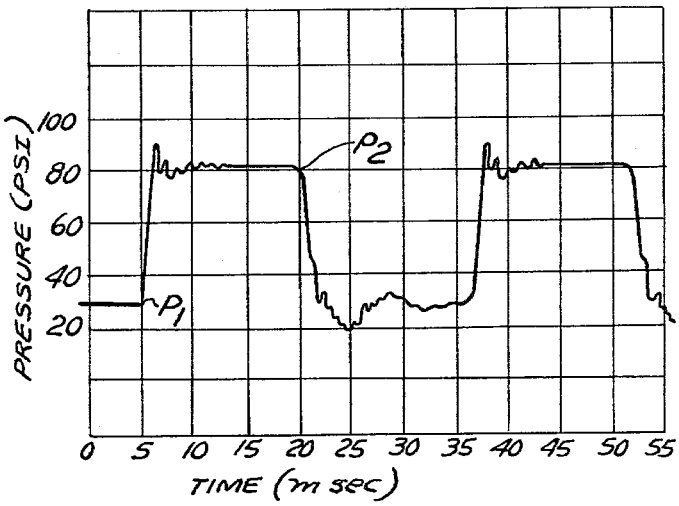
FIG. 4 illustrates the pressure wave developed within the system of FIG. 1.

Reference is now made to FIG. 1 which shows a fuel supply system 20 for supplying fuel from a fuel reservoir 22 to at least one injector 52. It will be apparent from the ensuing discussion that the present invention is applicable to a multipoint fuel injection system wherein each injector supplys fuel to the engine in the vicinity of the cylinder intake valve. In addition the present invention is equally applicable to a single point injection system having a single fuel injection valve and where fuel is introduced into the intake manifold at location proximate to that location where air is input to the engine.

Fuel is taken from the reservoir 22 through a delivery line 24 by pump 26. One skilled in the art will appreciate that it is preferable for pump 26 to be of the known variety such as a continuous flow pump. As one skilled in the art will further appreciate the purpose of the pump 26 is to provide a source of pressurized fuel at an output orifice of the pump. The output of the pump 26 is connected to the check valve central metering system 30 of the present invention. The system 30 comprises a pressure regulating means comprising a series combination of two pressure regulators 34 and 36 connected so that the inlet of pressure regulator 34 is connected to the output of pump 26 and that the output of pressure regulator 34 is in fluid communication with the input of pressure regulator 36. The output of pressure regulator 36 is connected in part to a return line 38 which will bring excess fuel back to the fuel reservoir 22.

A 3-way valve 40 having input orifices 42 and 44 and an output orifice 46 is connected in fluid communications with the pump 26. More particularly the input orifice 42 is connected between the pump 26 and pressure regulator 34. The other input inlet orifice 44 of the 3-way valve is connected to a series combination of a fuel rail 50 which is adapted to be in fluid of injectors 52 known variety of valve such as a pressure operated poppit valve. The other end of the fuel rail 50 is connected to check valve 54. Check valve 54 is connected in fluid communication to the common node between pressure regulator 34 and pressure regulator 36. In addition, check valve 54 is positioned so that fluid flow can be directed from its connection point with the two pressure regulators 34 and 36 into the fuel rail 50. The output 46 of the 3-way valve is connected to a second return line 60 having a constriction or orifice 62 therein. The return line 60 is connected to a return line 38. One skilled in the art will appreciate that orifice 62 can be replaced by a third pressure regulator. Reference will now be made to FIG. 2 which illustrates the de-energized or non-injecting mode of the present invention. FIG. 3 illustrates the energized or fuel injecting mode. These features permit the fuel system to additionally be characterized as having a fuel recirculating configuration in the non-injecting mode and having a dead ended reverse flow configuration in the injecting mode. To practice the present invention it has been found desirable to have pressure regulator 34 capable of regulating fuel within the system to a higher pressure than that which pressure regulator 36 can regulate the fuel pressure. As an example it has been found that rapid and accurate fuel metering is achieved if regulator 34 is sized to limit the pressure at about 87 psi while pressure regulator 36 can be chosen to limit the pressure at about 29 psi. It is required that the fuel injectors 52 be capable of opening and delivering fuel to the engine at a pressure less than or equal to that of the pressure maintained by pressure regulator 34.

Consider the operation check valve fuel system 30 as shown in FIG. 2. The system is shown in its de-energized or non-injecting mode. During this de-energized mode fuel from the reservoir 22 is pumped through pressure regulator 34. The pressure within the de-energized system is maintained at a pressure approximate that determined by the pressure regulator 36. Fuel passes through check valve 54 through the injectors 52, the 3-way valve, the second return line 60 and orifice 62. The fuel is then returned to the reservoir via return line 38. Since the pressure in the check valve system during the de-energized mode is at a pressure of $P_1$ the injectors 52 will not open. As can further be seen from FIG. 2 a continuous flow system has been achieved. The continuous flow system minimizes the effects of trapped air bubbles within the fuel as well as minimizes the effects of vaporization of the fuel as the fuel flows over the hot engine. In the preferred embodiment it is desirable to chose a check valve 54 designed to have a minimum pressure drop thereacross. One such check valve would be a check valve of the type which has a large orifice and a rubber flapper valve. It is believed that the orifice 62 may be eliminated from the check valve system. However, in the preferred embodiment the orifice 62 operates as an inexpensive pressure regulator maintaining the pressure within the return line 60 during the de-energized mode. One skilled in the art will appreciate that the orifice size of orifice 62 is determinable once the nominal flow characteristics of pump 26 have been chosen. The size of the orifice is chosen to achieve a pressure drop of $P_1$.

The system operating configuration for the check valve system 30 during its energized mode is shown in FIG. 3. In response to commands from an electric controller 64, the 3-way valve closes the exit orifice 46 and permits fuel to flow at a regulated pressure of $P_2$ into the 3-way valve and out orifice 44 into the fuel rail 50. As a consequence of the switching of the 3-way valve 40, a reverse flow is initiated through the 3-way valve and fuel rail 50. A pressure wave is created which travels through the fluid rail 50 wherein the injectors open and begin supplying fuel to the engine and the check valve 54 closes therein maintaining the fluid within the fuel rail during the injecting mode at a pressure $P_2$ which is in excess of the pressure necessary to open the poppit valve injector 52.

Figure 5:
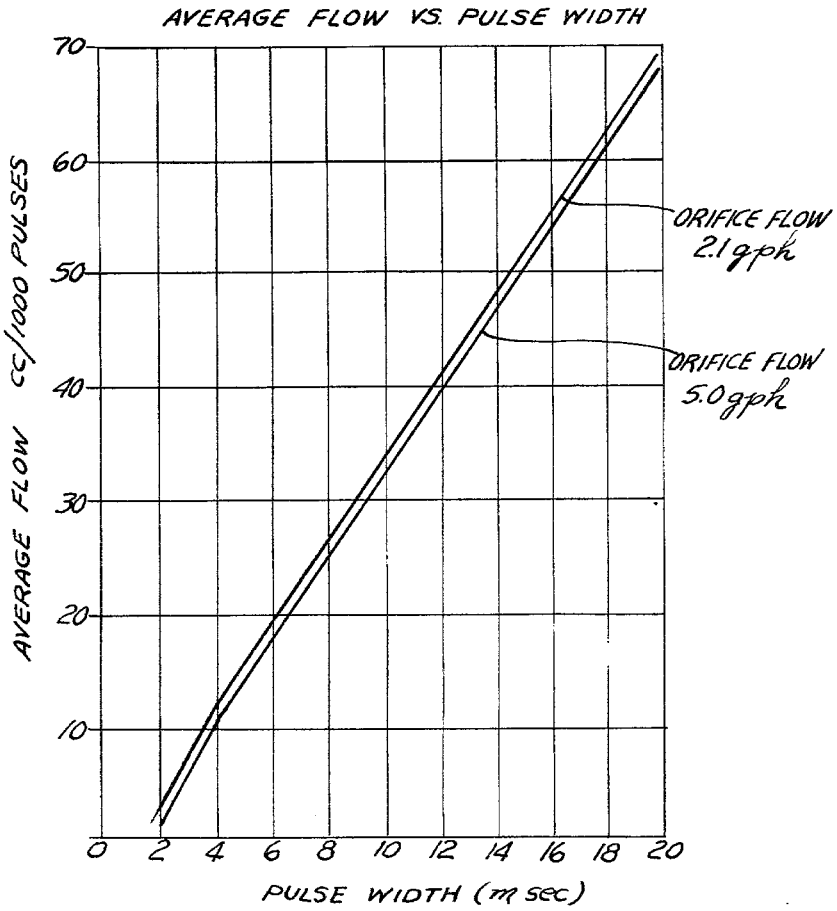
FIG. 5 illustrates the relationship between metered fuel and the duration of the pressure wave.

A feature of the present system which can be seen from the test results shown in FIG. 4 is that the present check valve central metering system 30 is characterized by a pressure wave which rises and falls relatively fast. The sharply rising and falling pressure wave therein permits rapid switching of the injectors 52 to achieve accurate fuel metering. It is apparent that the amount of fuel delivered by each injector is determinable from the amount of time that the 3-way valve 40 supplies high pressure fluid to the injectors. The relationship between delivered fuel and pulse width; that is, the time the 3-way valve permits high pressure fuel to be supplied is shown in FIG. 5. These test results demonstrate a desirable linear relationship for typical designed flow rates of 2.1 gph and 5 gph. Reference is again made to FIG. 4 which illustrates the pressure wave developed in a fuel system upon commanding the 3-way valve to its alternating positions. One method of controlling the rapid rise time of the pressure wave is to maintain a substantial difference between the regulated pressures $P_2$ and $P_1$. Alternatively, rapid injector opening can be achieved by choosing the lower regulated pressure, that is, $P_1$ as a threshold which is just below that value of pressure necessary to open the injectors.

During the energized or injecting mode fuel which may be caught in the second return line 60 is returned to the reservoir 22. When the control unit commands the check valve fuel 30 system into its non-injecting mode an initial sharp pressure drop will be achieved rapidly closing the injectors 52. The desirable rapid pressure drop is caused because the return line 60 is empty and the pressure in that line will be low until the flow in the non-injecting path or return line 60 is stabilized to its normal value.

I claim:

1. A fuel system for supplying fuel to an internal combustion engine having at least one fuel injector, a control unit for generating control signals in timed relation to the combustion processes therein, and a source of pressurized fuel, the system comprising:

fuel rail means having a first and a second end for receiving pressurized fuel and having means for delivering said fuel to the at least one fuel injector;

bi-level means in fluid communication with the source of pressurized fuel for selectively maintaining the pressure within said fuel rail means at a first and second level of pressure, said bi-level means further including a first and a second pressure regulator connected in series, said series combination having an input, an output and common node;

a check valve means in fluid communication with said second end of said fuel rail means for permitting fluid to flow from said common node into said fuel rail means;

a three-way valve means having first, second and third orifices in fluid communication with said bi-level means and said fuel rail means, for selectively communicating, in response to external control signals, fuel at said first and at said second pressure levels to said fuel rail means;

a first conduit means for providing fluid communication between said first orifice and the inlet of said bi-level means;

a second conduit means for providing fluid communication between said second orifice and the first end of said fuel rail;

a third conduit means for providing fluid communication between said third orifice and the outlet of said bi-level means; and exit conduit means in fluid communication with said third orifice and said outlet of said bi-level means for permitting fuel to exit therefrom.

2. The fuel system as recited in claim 1 wherein said third conduit means contains a third pressure regulating means for maintaining the pressure within said third conduit means at a determinable value.

3. The fuel system as recited in claim 2 wherein said third pressure regulating means is an orifice.

4. The fuel system as recited in claim 3 wherein said first pressure level is lower than said second pressure level.

5. A method of metering fuel to an internal combustion engine from a fuel injector in fluid communication with the engine and a fuel rail of a fuel system having an injection and non-injection mode of operation; the steps of which comprise:

causing pressurized fuel at a first determinable pressure level to flow within the fuel rail;

operating said fuel system in the fuel recirculating configuration during times not involving fuel injection;

changing the configuration of said system to a dead ended configuration during times involving fuel injection;

causing fuel to flow from said fuel injector while said fuel system is in said dead ended configuration;

returning the configuration of said fuel system, after a determinable length of time to said fuel recirculating configuration; and reversing the direction of fuel flow through said fuel rail.

6. The method as recited in claim 5 wherein said step of causing fuel to flow from said injector includes increasing the pressure of fuel within said fuel rail to a level greater than said first determinable pressure level.

7. In combination at least one fuel injector and a fuel system having injection and non-injection modes of operation, for transporting fuel from an external fuel source to the fuel injector comprising:

a fuel rail means having a first end for receiving the pressurized fuel from the external fuel source and having means for connecting said fuel rail in fluid communication with said fuel injector;

central metering means in fluid communication with the external fuel source and said fuel rail means for transforming the fuel system from a fuel recirculating configuration during the non-injection mode of operation to a dead ended configuration during the injection mode of operation and reverse flow means connected to said fuel rail means for changing the direction of fuel flow through said fuel rail means during said modes of operations.

8. The combination of claim 7 wherein said fuel injector is of the type actuated by pressure.

9. A fuel system for transporting pressurized fuel from an external fuel source to at least one fuel injector having injection and non-injection modes of operation, said system comprising:

fuel rail means having a first end for receiving pressurized fuel from the external fuel source and having means for connecting said fuel rail in fluid communication with the at least one fuel injector;

central metering means in fluid communication with the external fuel source and said fuel rail means, for transforming the fuel system from a fuel recirculating configuration during the non-injection mode of operation to a dead ended configuration during the injection mode of operation; and reverse flow means connected to said fuel rail means for changing the direction of fuel flow through said fuel rail means during said modes of operation.

10. The fuel system as recited in claim 9 wherein said reverse flow means comprises:

a bi-level means including a series combination of a first and a second pressure regulating means, for maintaining the pressure within said fuel rail means at a first and at a second determinable pressure level, said bi-level means having an input in fluid communication with the external fuel source, an output and a common node, and connected so that during the non-injection mode of operation, the pressure within said fuel rail means is determined by said first pressure regulating means and that during fuel injection mode of operation the pressure within said fuel rail means is determined by said second pressure regulating means.

11. The fuel system as recited in claim 10 wherein said reverse flow means further comprises valve means connecting said bi-level means and said fuel rail means and responsive to control signals input thereto for selectively switching said central metering system from said fuel recirculating configuration to said dead ended configuration.

12. The fuel system as recited in claim 11 wherein said central metering means further comprises a return conduit in fluid communication with said valve means and said bi-level means for permitting fuel to exit therefrom.

13. The fuel system as recited in claim 12 wherein said valve means comprises:

a three-way valve in switchable fluid communication with said inlet and said outlet of said bi-directional pressure means, and said first end of said fuel rail means; and a check valve means in fluid communication with the common node of said bi-level means and said second end of said fuel rail means for permitting fuel to flow from said common node of said bi-level means into said fuel rail means.

14. The fuel system as recited in claim 13 wherein said system further comprises a second return conduit interposing said valve means and said outlet of said bi-level means including a third pressure regulating means for maintaining the fuel pressure in said second return conduit during periods involving said recirculating configuration.

15. The fuel system as recited in claim 14 wherein said third pressure regulating means is an orifice.

16. The fuel system as recited in claim 15 wherein said check valve metering means further contains means for connecting said return conduit to said source of fuel.

* * * * *